US006634682B2

(12) United States Patent
Fukunaga et al.

(10) Patent No.: US 6,634,682 B2
(45) Date of Patent: Oct. 21, 2003

(54) VEHICLE DOOR LOCK APPARATUS

(75) Inventors: Katsutoshi Fukunaga, Chiryu (JP); Makoto Suzumura, Kariya (JP); Ryujiro Akizuki, Kariya (JP); Norio Konomoto, Nagoya (JP); Akira Muramatsu, Chiryu (JP); Shigeru Hayakawa, Chiryu (JP); Yasuhiko Sono, Hekinan (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/983,902

(22) Filed: Oct. 26, 2001

(65) Prior Publication Data

US 2002/0056996 A1 May 16, 2002

(30) Foreign Application Priority Data

Oct. 26, 2000 (JP) ..... 2000-327319

(51) Int. Cl.[7] ..... E05C 3/16
(52) U.S. Cl. ..... 292/216; 292/DIG. 23
(58) Field of Search ..... 292/216, 201, 292/DIG. 23, 337; 70/264

(56) References Cited

U.S. PATENT DOCUMENTS 3,601,883 A * 8/1971 Arlauskas ..... 29/434
4,575,138 A * 3/1986 Nakamura ..... 292/216
4,679,836 A * 7/1987 Pupillo ..... 292/216
4,969,672 A * 11/1990 Childs ..... 292/201
4,993,249 A * 2/1991 Schumacher ..... 70/264
5,603,539 A * 2/1997 Gruhn ..... 292/216
5,855,130 A * 1/1999 Rorabacher ..... 70/277
5,951,070 A * 9/1999 Spurr ..... 292/201
6,053,543 A * 4/2000 Arabia ..... 292/201
6,102,453 A * 8/2000 Cetnar ..... 292/201
6,109,674 A * 8/2000 Bartel ..... 292/337
6,168,215 B1 * 1/2001 Kodama ..... 292/201
6,302,734 B1 * 10/2001 Ichio ..... 439/587
6,371,537 B1 * 4/2002 Vige ..... 292/201

FOREIGN PATENT DOCUMENTS

JP 2516432 B2 4/1996

* cited by examiner

*Primary Examiner*—Gary Estremsky
(74) *Attorney, Agent, or Firm*—Burns, Doane, Swecker & Mathis, LLP

(57) ABSTRACT

A vehicle door lock apparatus includes a first body and a second body integrated so as to be adapted to be integrally assembled to the door. The vehicle door lock apparatus further includes guide projections formed at one of the first and second bodies, and guide grooves formed at the other of the first and second bodies. In addition, a stopper is provided for preventing the separation of integrated first and second bodies by the engagement between the guide projections and the guide grooves.

19 Claims, 13 Drawing Sheets

VEHICLE DOOR LOCK APPARATUS

This application is based on and claims priority under 35 U.S.C. §119 with respect to Japanese Application 2000-327319 filed on Oct. 26, 2000, the entire content of which is incorporated herein by reference.

FIELD OF THE INVENTION

This invention generally relates to a door lock. More particularly, the present invention pertains to a vehicle door lock apparatus.

BACKGROUND OF THE INVENTION

A known vehicle door lock apparatus is disclosed in Japanese Patent Publication No. 2516432 published on Jul. 24, 1996. The disclosed vehicle door lock apparatus is formed with a first body accommodating a latch mechanism which includes a latch for opening and closing the vehicle door through engagement with a striker provided at the vehicle-body side and a pawl for restricting rotation of the latch through engagement of the pawl with the latch. The vehicle door lock apparatus is also formed with a second body accommodating an operation mechanism which activates the pawl. The first body is integrated with the second body so as to be integrally assembled to the door.

In the vehicle door lock apparatus disclosed in the publication mentioned above, the first body and the second body are configured to be integrated by a connecting member (e.g., a screw or a pin fixed by riveting). This construction thus requires additional parts as well as assembly work and time, thus leading to increased cost.

A need thus exists for a vehicle door lock apparatus that can be manufactured less expensively than other known door lock apparatus such as described above.

A need also exists for a vehicle door lock apparatus in which the first and second bodies are integrated in a way that does not require the same number of components as other known apparatus and does not require the same degree of assembly work as other known apparatus.

SUMMARY OF THE INVENTION

According to an aspect of the present invention, a vehicle door lock apparatus includes a first body having a body and a base plate, a latch mechanism accommodated between the body and the base plate, with the latch mechanism including a latch adapted to engage a striker on the vehicle and a pawl for restricting rotation of the latch through engagement of the pawl with the latch, a second body having a housing main body and a cover connected to the housing main body, and an operation mechanism accommodated between the housing main body and the cover to activate the pawl. A guide projection is provided at one of the first body and the second body, and a guide groove is provided at the other one of the first body and the second body, with the guide projection engaging the guide groove so that the first and second bodies are integrated with one another. A stopper is also provided between the first body and the second body for preventing separation of the first and the second bodies.

According to another aspect of the invention, a vehicle door lock apparatus includes a first body accommodating a latch mechanism which includes a latch for effecting opening and closing of a vehicle door through engagement with a striker provided at a vehicle-body side and a pawl for restricting rotation of the latch through engagement of the pawl with the latch, and a second body accommodating an operation mechanism which activates the pawl. The first body is integrated with the second body for being integrally assembled to the vehicle door. A guide projection is formed at one of the first body and the second body, and a guide groove is formed at the other one of the first body and the second body, with the guide groove being engaged with the guide projection. A stopper is provided between the first body and the second body for preventing separation of the integrated first and the second bodies by the engagement between the guide projection and the guide groove.

As compared to a door lock apparatus employing a connecting member to integrate the first body and the second body, the number of components used in the door lock apparatus of the present invention is reduced and the assembly of the apparatus is made easier. Thus, the cost associated with manufacturing the door lock apparatus can be reduced.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
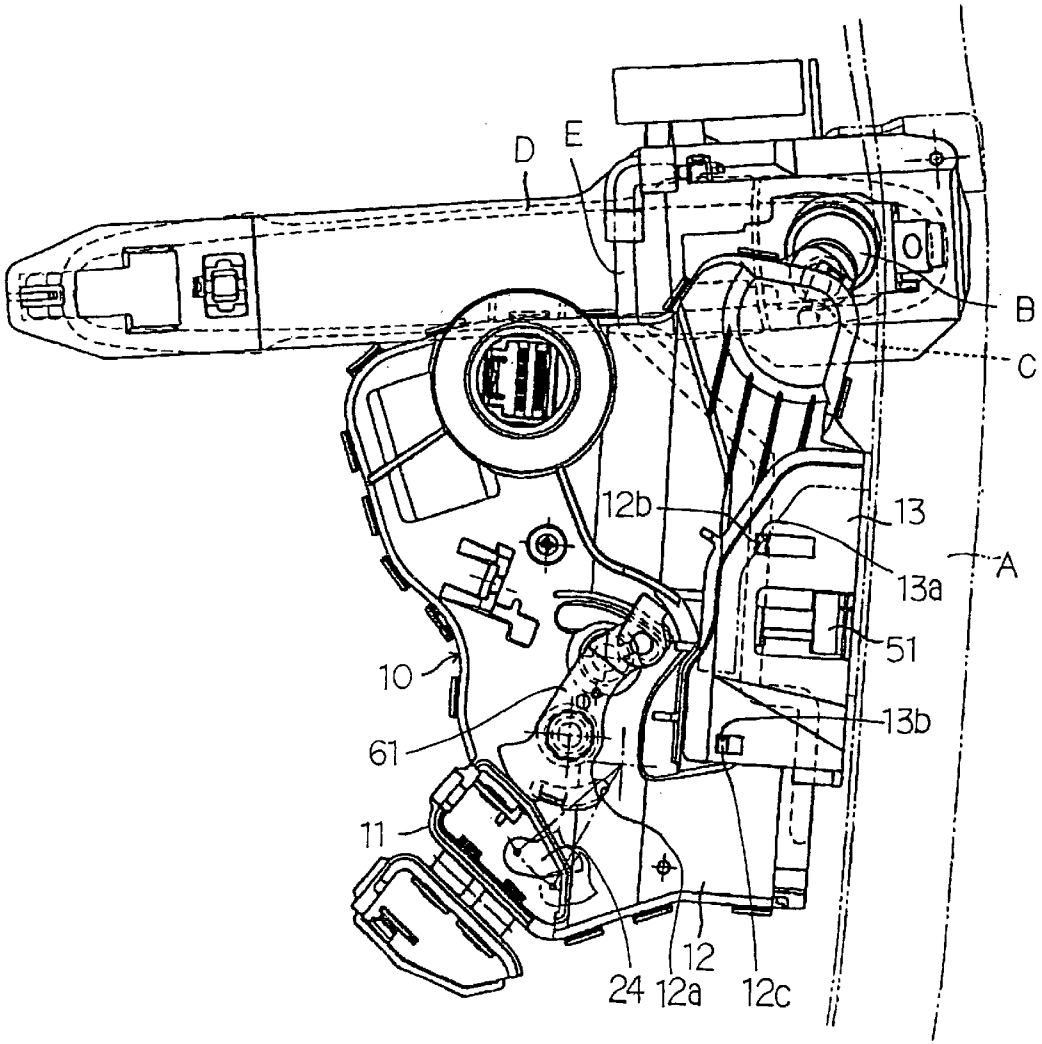
FIG. 1 is a side view of the interior of a vehicle door lock apparatus provided within a door and viewed from the vehicle-body side according to the present invention.
Figure 2:
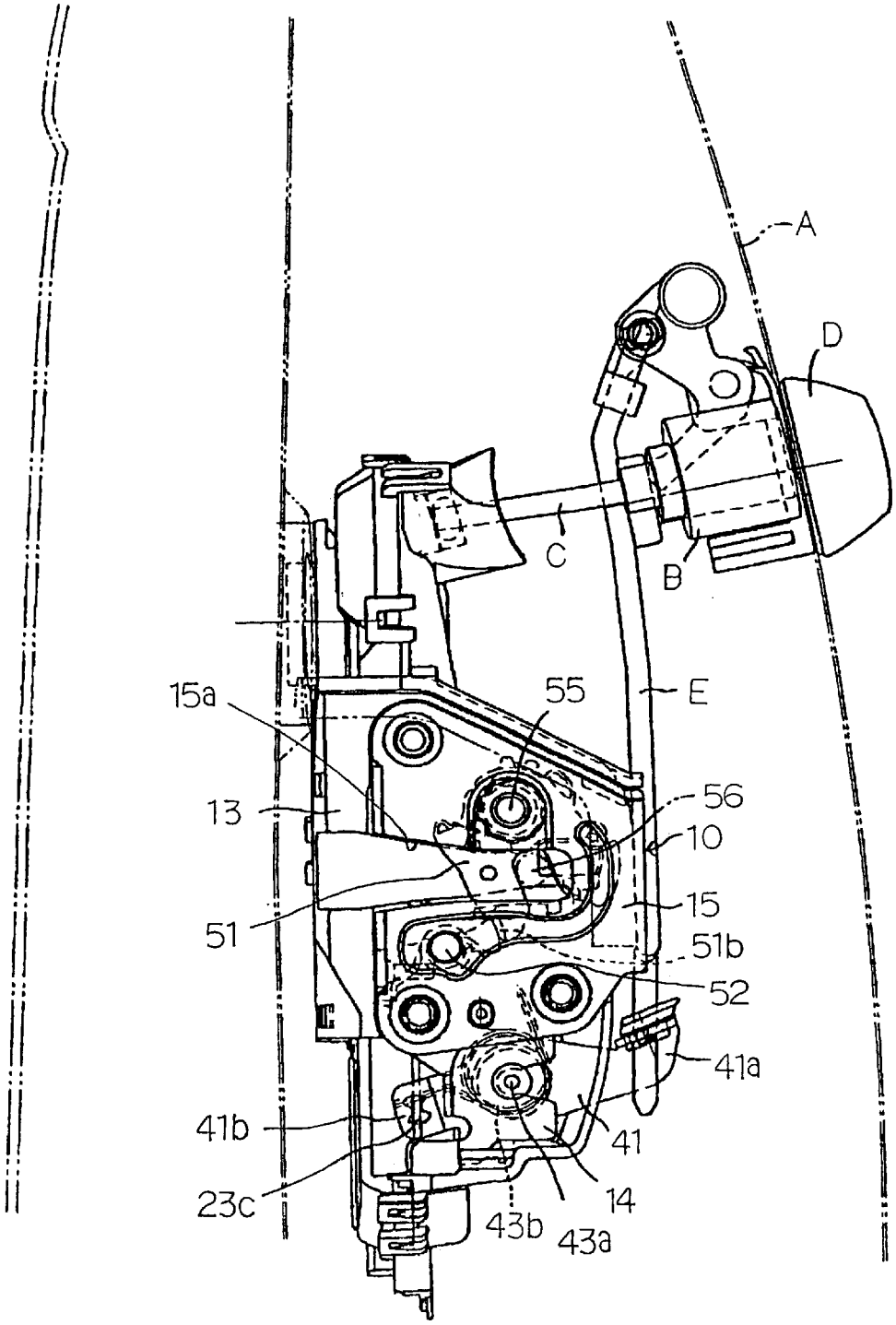
FIG. 2 is a rear view of the vehicle door lock apparatus shown in FIG. 1 viewed from the rear side of the door.
Figure 3:
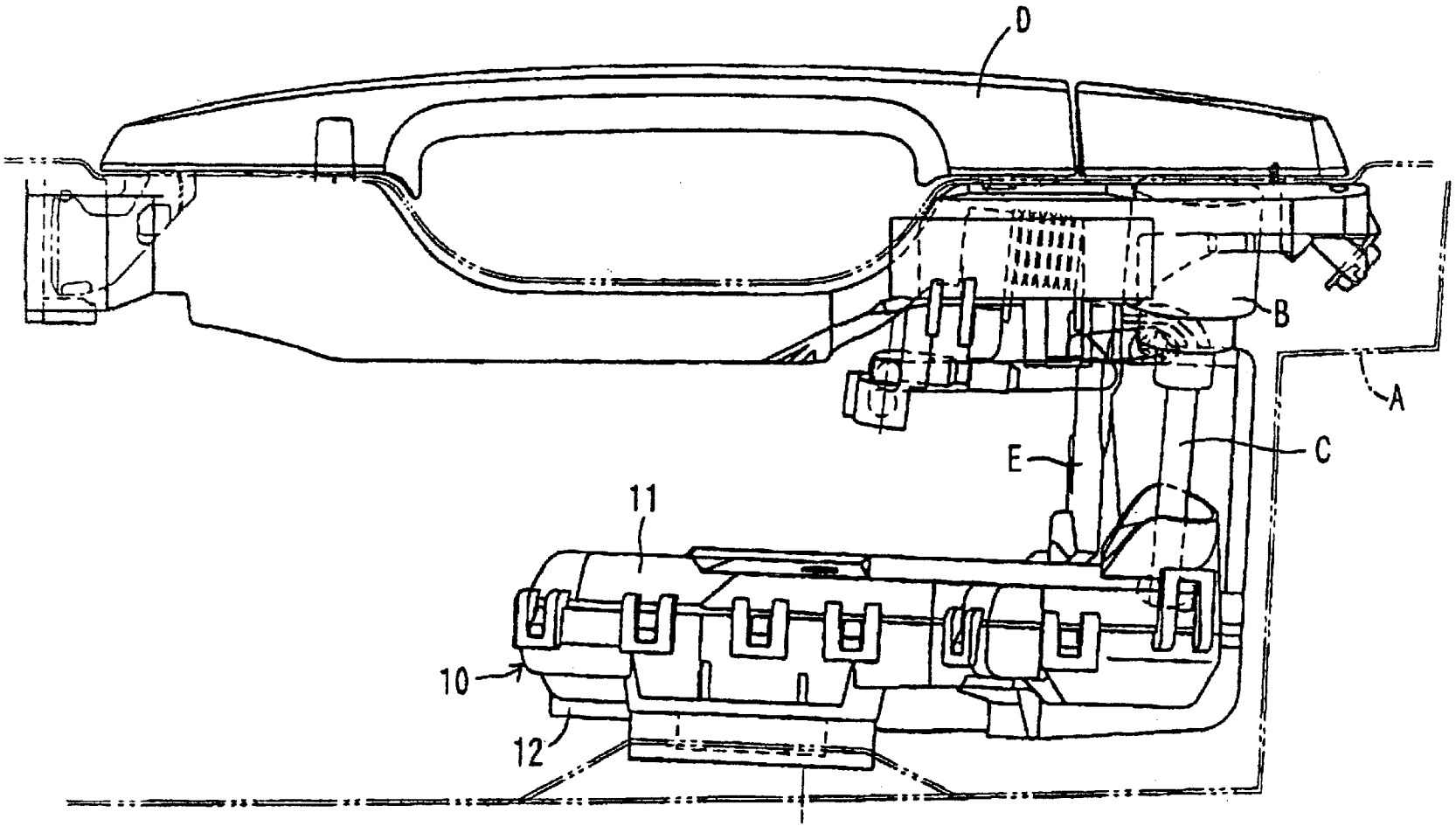
FIG. 3 is a plan view of the vehicle door lock apparatus shown in FIG. 1 viewed from above.
Figure 4:
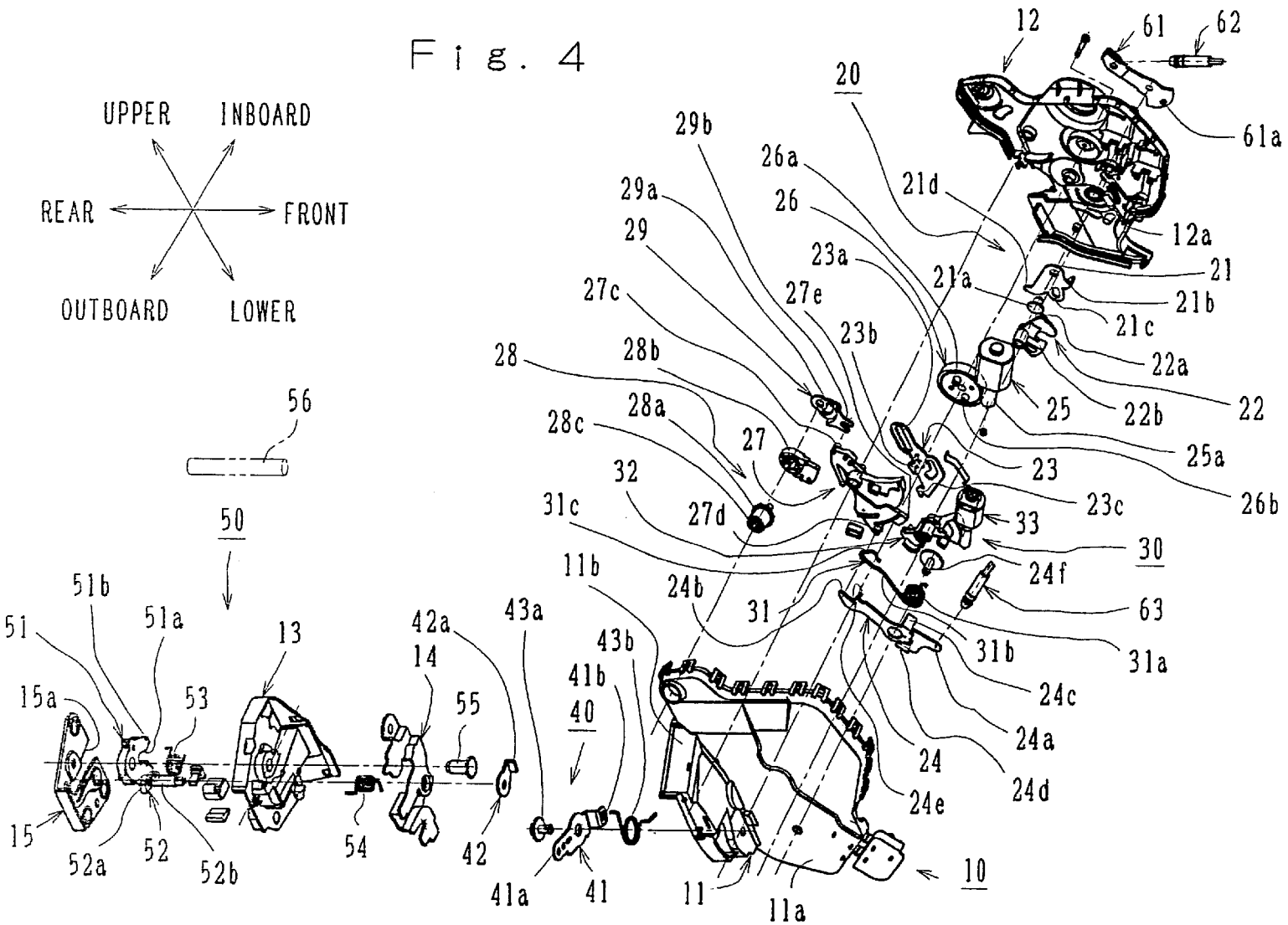
FIG. 4 is an exploded perspective view of the vehicle door lock apparatus shown inn FIG. 1.

Referring to FIG. 1 which is an inside view of the vehicle door lock apparatus of the present invention provided within a door A and viewed from the vehicle-body side and FIGS. 2–4, the door lock apparatus includes a housing 10 in which a first operation mechanism 20, a second operation mechanism 30, and a third operation mechanism 40 are accommodated. The door lock apparatus also includes a body 13 in which a latch mechanism 50 is accommodated. The arrows in FIG. 4 indicate the front and rear of the vehicle, the upper and lower directions, and the inboard and outboard sides of the vehicle body.

The housing 10 of the door lock apparatus is provided with a resinous housing main body 11, a resinous cover 12, and a resinous body 13. The housing main body 11 includes a dish-shaped first case portion 11*a* which opens to the inside, and a dish-shaped second case portion 11*b* which extends perpendicularly to the first case portion 11*a* and opens rearward. The open side of the first case portion 11*a* is coupled with the cover 12 to close the open side of the first case portion 11*a,* and the open side of the second case portion 11*b* is coupled with the body 13 together with a sub base plate 14 and a base plate 15 to close the open side of the second case portion 11*b*.

As shown in FIG. 4, the components of the first operation mechanism 20 and the second operation mechanism 30 are provided inside an interior portion defined between the first case portion 11*a* of the housing main body 11 and the cover 12. Similarly, the sub base plate 14 and the components of the third operation mechanism 40 are provided inside an interior portion defined between the second case portion 11*b* of the housing main body 11 and the body 13. A rear open portion of the body 13 is coupled with the base plate 15 to close the open portion. The components of the latch mechanism 50 are provided inside an interior portion defined between the body 13 and the base plate 15.

Figure 5:
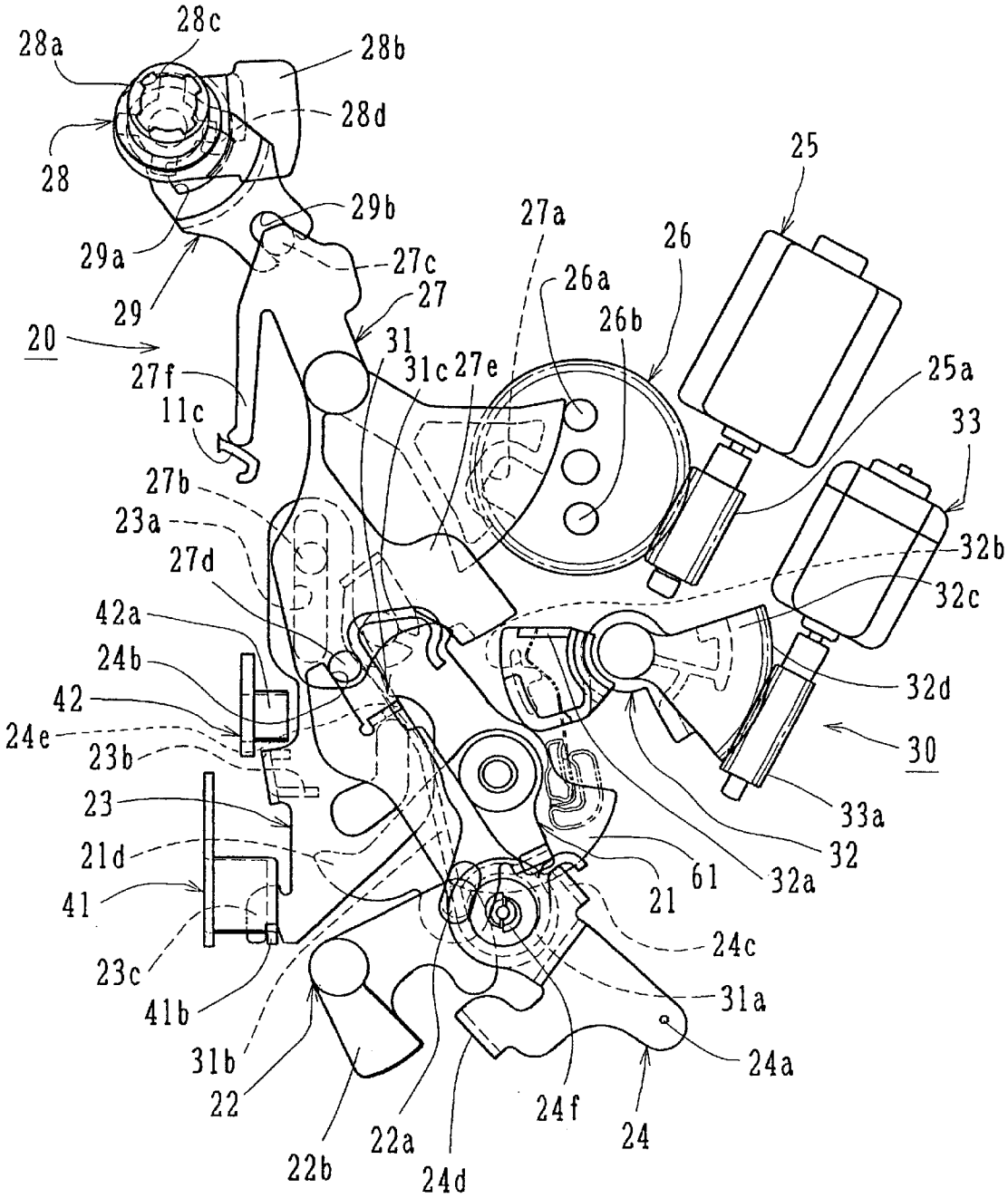
FIG. 5 is a side view showing how components of the vehicle door lock apparatus operate under the unlocked state.

As shown in FIGS. 4 and 5, the first operation mechanism 20 is provided with a first inside lever 21, a second inside lever 22, an open link 23, a lock operation lever 24, a first electric motor 25, a wheel gear 26, an active lever 27, a key lever 28, and an idle lever 29. FIG. 5 shows each component of the first operation mechanism 20 and the second operation mechanism 30 viewed from outside the vehicle.

The first inside lever 21 is rotatably assembled inside the cover 12 via a support pin 21*a*. A third inside lever 61 is rotatably assembled outside the cover 12 via the common support pin 21*a*. The first inside lever 21 is provided with an engaging projection 21*b* extending toward the cover 12. The engaging projection 21*b* extends completely through an arc-shaped hole 12*a* of the cover 12 and is engaged with a connecting hole 61*a* of the third inside lever 61. As a result, the first inside lever 21 and the third inside lever 61 are connected together as a unit. The third inside lever 61 is connected with one end of an inside cable 62 (specifically an inner wire) whose other end is connected with an inside handle (not shown) provided at the vehicle-body side of the door A. By manipulating the inside handle in the open direction (i.e., an opening operation of the inside lever), the third inside lever 61 is rotated in the clockwise direction of FIG. 5 and causes the first inside lever 21 to rotate in the clockwise direction.

The second inside lever 22 is rotatably assembled inside the cover 12 and is placed outside the first inside lever 21. The second inside lever 22 is provided with an engaging pin 22*a* extending toward the cover 12, and an engaging arm portion 22*b* placed at the side of the housing main body 11. By inserting the engaging pin 22*a* into a slot 21*c* of the first inside lever 21, the second inside lever 22 is connected with the first inside lever 21.

The open link 23 placed outside the first inside lever 21 is provided with an elongated engaging slot 23*a* through which a first engaging pin 27*b* of an active lever 27 (described in more detail below) is inserted, an L-shaped engaging portion 23*b* with which a tip portion 21*d* of the first inside lever 21 is in contact and in engagement, and a connecting portion 23*c* adapted to be connected to an open lever 41 which will be described in more detail below. The open link 23 is supported by the active lever 27 and the open lever 41.

The lock operation lever 24 is rotatably assembled inside the first case portion 11*a* of the housing main body 11. The lock operation lever 24 is provided with a mounting hole 24*a* to which is secured a locking cable 63, a receiving portion 24*b* for receiving a third engaging pin 27*d* of the active lever 27, an engaging portion 24*c* for engaging one end of an engaged lever 31, and a contacting portion 24*d* with which a tip portion of the engaging arm portion 22*b* of the second inside lever 22 is in contact. The locking cable 63 (i.e., the inner wire) is connected with a lock knob (not shown) provided at the vehicle-body side of the door A and is also connected with the lock operation lever 24 via the mounting hole 24*a*. When the lock knob is operated to be locked, the locking cable 63 transmits the operation force of the lock knob to the lock operation lever 24 and rotates the lock operation lever 24 in the clockwise direction of FIG. 5. When the lock knob is operated to be unlocked, the locking cable 63 transmits the operation force of the lock knob to the lock operation lever 24 and rotates the lock operation lever 24 in the counterclockwise direction of FIG. 5.

The first electric motor 25 functions to output an operation force for driving the first operation mechanism 20. The first electric motor 25 is mounted inside the cover 12 and is provided with a worm 25*a* which is integrally assembled on an output shaft of the first electric motor 25. The worm 25*a* is in meshing engagement with a gear portion of the wheel gear 26. The first electric motor 25 is under remote control operation of a lock/unlock switch (lock/unlock operation) provided in each of a key blade and a door-inside trim. The wheel gear 26, which functions as an output portion of the first electric motor 25, includes a pair of engaging pins 26*a,* 26*b* at the outer side. The wheel gear 26 is rotatably supported by the first case portion 11*a* and the cover 12. The engaging pins 26*a,* 26*b* are placed on a common circumference keeping a predetermined space therebetween and are opposed to each other with respect to the rotation axis of the wheel 26. When the wheel gear 26 is rotated in one direction, one of the engaging pins 26*a* is brought into contact with a sector portion of the active lever 27, and the other one of the engaging pins 26*b* is moved into an engaging concavity 27*a*. When the wheel gear 26 is rotated in the opposite direction, one of the engaging pins 26*a* is brought into disengagement from the sector portion of the active lever 27 while the other one of the engaging pins 26*b* is moved out of the engaging concavity 27*a*.

The active lever 27 is rotatably supported by the first case portion 11*a* and the cover 12, and is placed between the open link 23 and the lock operation lever 24. The active lever 27 includes the engaging concavity 27*a* (shown in FIG. 5), the first engaging pin 27*b* (shown in FIG. 5), and a second engaging pin 27*c* which face the cover 12. The active lever 27 also includes the third engaging pin 27*d* and a projection portion 27*e* which face the first case portion 11*a*. The active lever 27 further includes an arm 27*f* being engaged with the projection piece 11*c* formed at the housing main body 11 in an elastic manner.

With respect to the active lever 27, the engaging concavity 27*a* is opposed to the wheel gear 26, and the first engaging pin 27*b* is inserted into the engaging slot 23*a* of the open link 23. The second engaging pin 27*c* is engaged with a second engaging slot 29*b* of the idle lever 29, and the third engaging pin 27*d* is received in the receiving portion 24*b* of the lock operation lever 24. The projection portion 27*e* is disposed adjacent to an output lever 32. In addition, when the wheel gear 26 is rotated in one direction or the other direction, either the pin 26*a* or the pin 26*b* is selectively moved into or from the engaging concavity 27*a* of the active lever 27 to be engaged or disengaged therewith, and the active lever 27 is selectively rotated in the clockwise direction or the counterclockwise direction of FIG. 5.

The key lever 28 is provided with a column-shaped or bar-shaped main body 28*a* and a lever portion 28*b* integrally formed therewith. The key lever 28 is rotatably supported together with the idle lever 29 by the first case portion 11*a* of the housing main body 11. The column-shaped main body 28*a* includes a groove 28*c* into which the tip portion of a rod C is disposed, The rod C extends from a key cylinder B (shown in FIGS. 1–3) and transmits torque. An engaging pin 28*d* (shown in FIG. 5) is formed at the rear side of the lever portion 28*b* for being inserted into an arc-shaped first engaging slot 29*a* provided at the idle lever 29.

A tip portion of the idle lever 29 is formed with the second engaging slot 29*b* which opens at the tip. The second engaging pin 27*c* of the active lever 27 is inserted into the second engaging slot 29*b*. The key lever 28, which is rotated when the key cylinder B is rotated by operating a key or key blade, causes the idle lever 29 to rotate selectively in the clockwise direction and the counterclockwise direction of FIG. 5 and causes, by way of the idle lever 29, selective rotation of the active lever 27 in the clockwise direction and the counterclockwise direction of FIG. 5.

The second operation mechanism 30 is provided with the engaged lever 31, the output lever 32, and a second electric motor 33. The engaged lever 31 is formed of a wire steel spring, or other elastic wire materials, and includes a coil-shaped base portion 31*a*, a lever portion 31*b* extending from the base portion 31*a* over a predetermined length, and a hook-shaped engaged portion 31*c* formed at the tip portion of the lever portion 31*b*. With the base portion 31*a* of the engaged lever 31 being wound around a support pin 24*f* which rotatably supports the lock operation lever 24, one end of the base portion 31*a* is engaged with the engaging portion 24*c* of the lock operation lever 24, and an intermediate portion of the lever portion 31*b* is engaged with an engaging portion 24*e* of the lock operation lever 24. The engaged lever 31 is assembled to the lock operation lever 24 to be operated therewith with the lever portion 31*b* being biased in the counterclockwise direction of FIG. 5. At the rear side of the tip portion of the lever portion 31*b*, the third engaging pin 27*d* of the active lever 27 is received by the engaged lever 31 and the receiving portion 24*b* of the lock operation lever 24.

Figure 8:
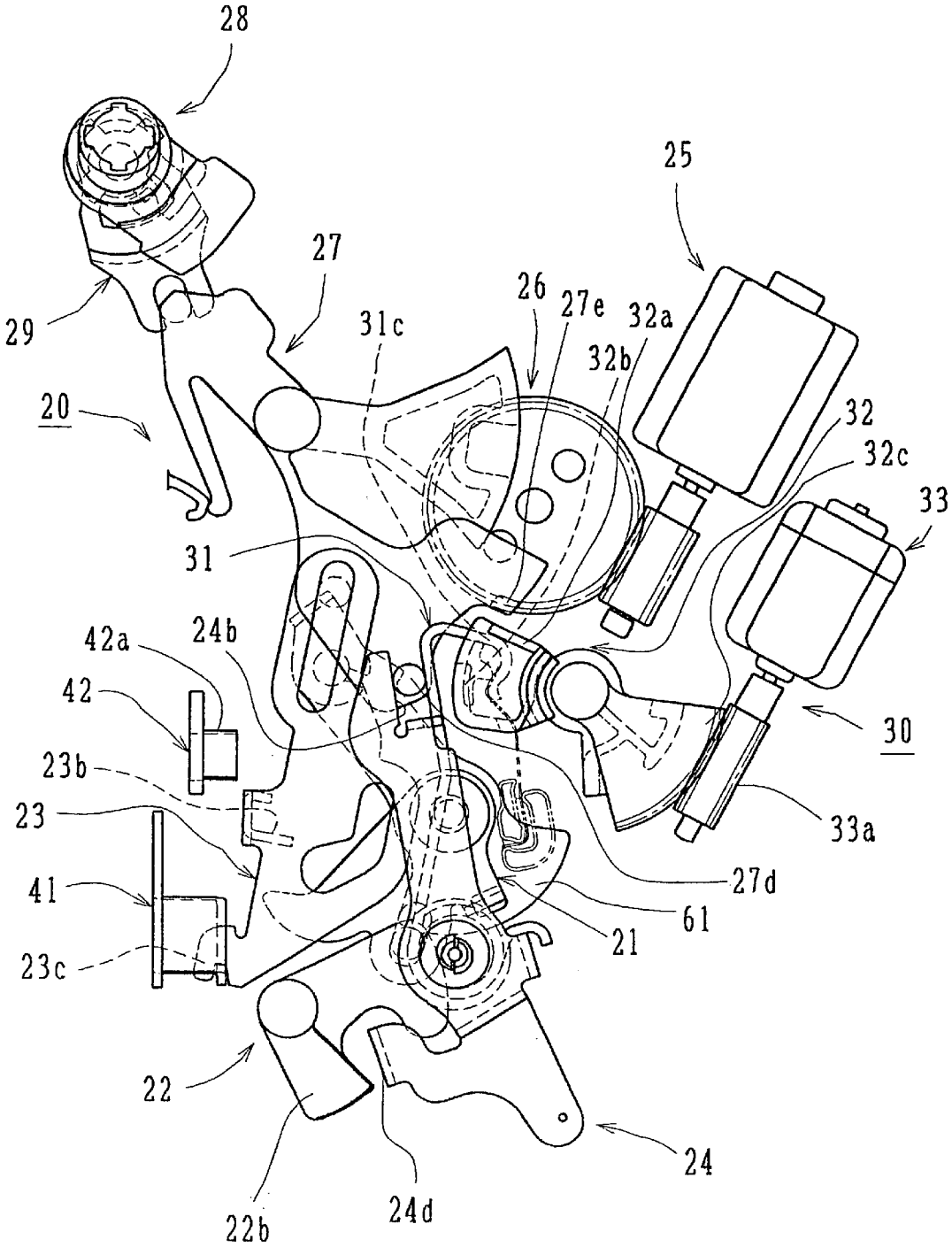
FIG. 8 is a side view showing how components of the vehicle door lock apparatus operate under the double-locked state.

The output lever 32 is rotatably assembled to the first case portion 11*a* and the cover 12. As shown in FIG. 5, the tip portion of a first swing arm portion 32*a*, disposed at one side of the output lever 32, is formed with an engaging portion 32*b*, and the periphery of the tip portion of a second swing arm portion 32*c*, disposed at the other side of the output lever 32, is formed with an arc-shaped gear portion 32*d*. The second electric motor 33 rotates the output lever 32 by a worm 33*a* mounted on an output shaft of the second electric motor 33 which meshes with the gear portion 32*d* of the output lever 32. The second electric motor 33 is under remote control operation (set/reset operation) of a double-lock switch provided in each of the key or key blade and the door-inside trim. When the engaged lever 31 is being moved into the double-lock operation position from the locked state shown in FIG. 6 and the output lever 32 is rotated in the clockwise direction by the second electric motor 33 being operated to produce an output rotation in the normal direction, the output lever 32 retains the engaged lever 31 in such a manner that the engaging portion 32*b* of the first swing arm portion 32*a* is brought into engagement with the engaged portion 31*c* of the engaged lever 31 as shown in FIG. 8.

Figure 6:
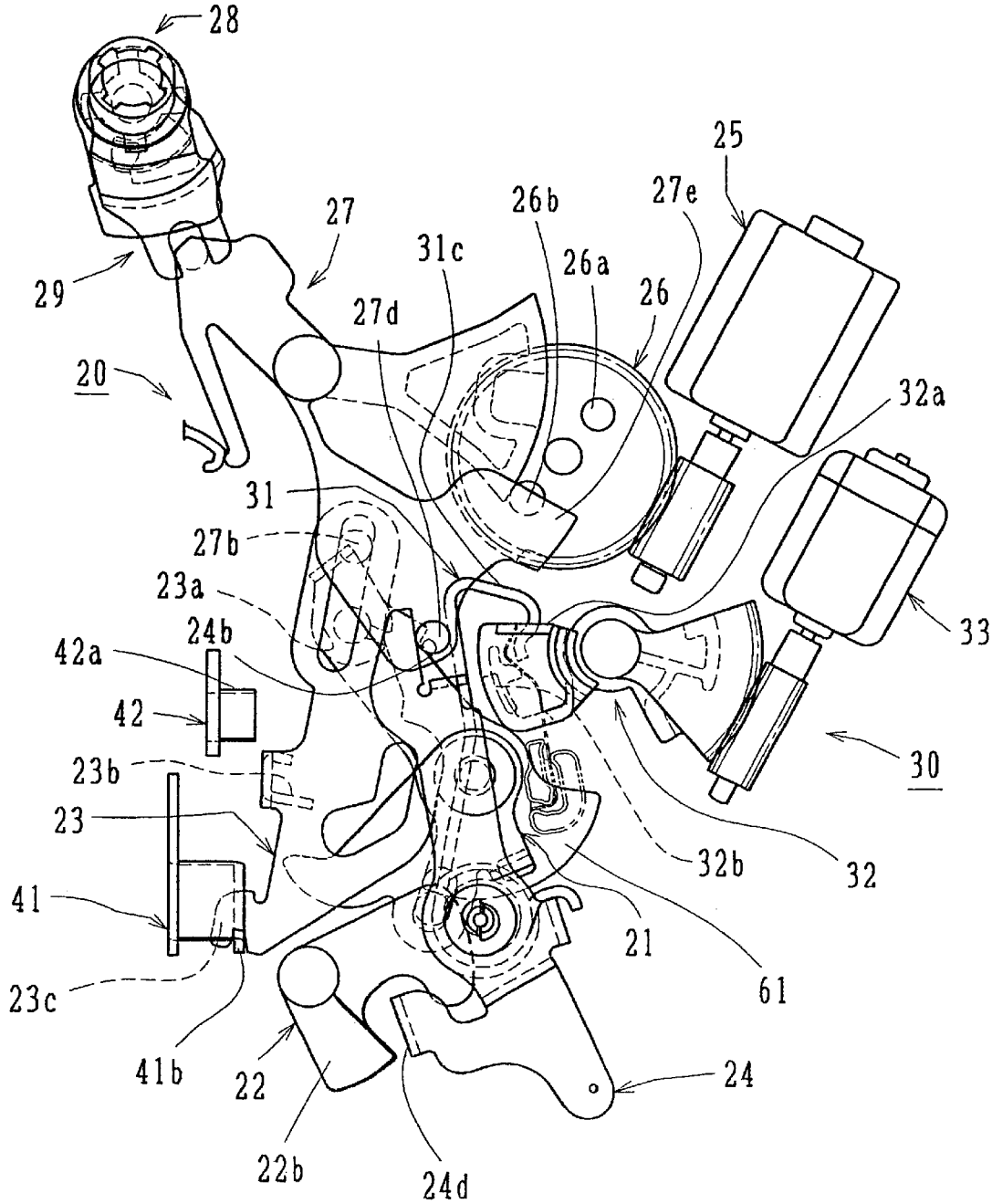
FIG. 6 is a side view showing how components of the vehicle door lock apparatus operate under the locked state.
Figure 7:
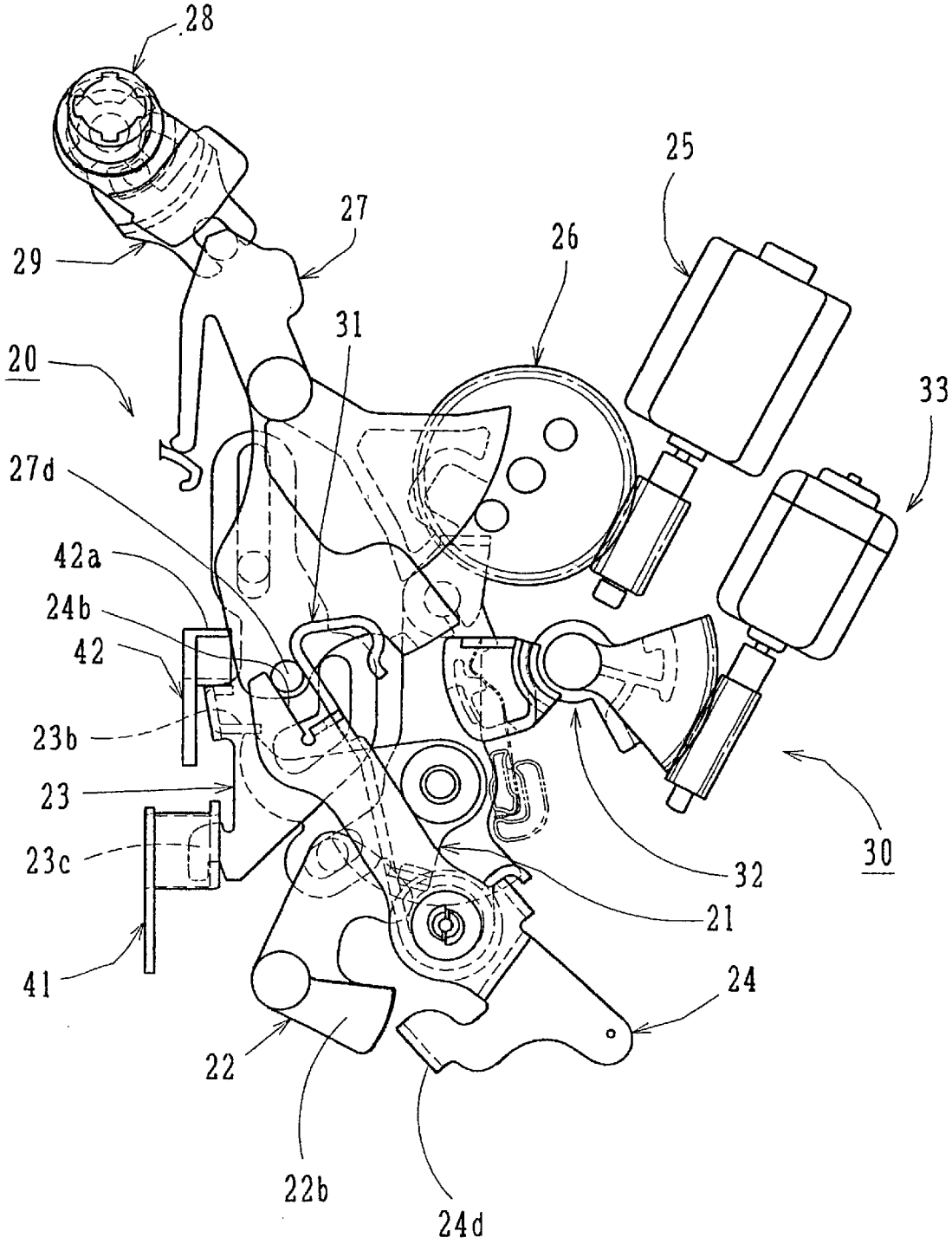
FIG. 7 is a side view showing how components of the vehicle door lock apparatus operate under the locked state with a one-motion operation being conducted.

The engagement state of the output lever 32 and the engaged lever 31 (i.e., the double-locked state) is released when the output lever 32 is rotated in the counterclockwise direction. Such a rotation of the output lever 32 can be established by transferring the active lever 27 to its unlock operation position in addition to reversing the second electric motor 33. When the output lever 32 is engaged with the engaged lever 31 (at a set position), the active lever 27 is shifted to the lock operation position as shown in FIG. 8, and the projection portion 27*e* of the active lever 27 is disposed adjacent to the upper side of the first swing arm portion 32*a* of the output lever 32. Accordingly, by rotating the active lever 27 in the clockwise direction, the projection portion 27*e* of the active lever 27 is brought into contact with the upper end portion of the first swing arm portion 32*a* of the output lever 32 to urge the first swing arm portion 32*a* downward. Then the output lever 32 is rotated through an angle in the counterclockwise direction which results in the engagement of the output lever 32 and the engaged lever 31 being released as shown in FIG. 6 (at the rest position).

Each component of the third operation mechanism 40 is provided between the second case portion 11*b* of the housing main body 11 and the body 13. The third operation mechanism 40 includes the open lever 41 and a lift lever 42. The open lever 41 is rotatably supported by a resinous support pin 43*a* and a torsion spring 43*b* between the second case portion 11*b* and the sub base plate 14. One rotation end portion 41*a* of the open lever 41 is connected with an outside link E which is in association with an outside handle D provided at the vehicle-outboard side of the door A, while the other rotation end portion 41*b* is connected with the connecting portion 23*c* of the open link 23. The open lever 41 is rotated to move the rotation end portion 41*b* upward against the force of the torsion spring 43*b* when the outside handle D is operated in an opening operation (opening operation in the vehicle-outboard direction). The lift lever 42 is fixedly mounted on a shaft portion 52*b* of a pawl 52 extending through the body 13. As shown in FIG. 5, an engaging piece 42*a* formed at a periphery of the lift lever 42 is placed above the upper end of the engaging portion 23*b* of the open link 23.

The latch mechanism 50 includes a latch 51, the pawl 52, a pair of torsion springs 53, 54 biasing the latch 51 and the pawl 52 respectively, and three rubber cushions shown in FIG. 4. The latch 51, the torsion spring 53 for biasing the latch 51, and a main body 52*a* of the pawl 52 are provided, together with the three rubber cushions, inside the body 13 between the body 13 and the base plate 15.

The latch 51 is rotatably supported between the body 13 and the base plate 15 by a support pin 55 which extends completely through the sub base plate 14, the body 13, and the base plate 15 and is supported thereby. One end of the torsion spring 53, which is coaxially assembled on the support pin 55, is engaged with the latch 51. The other end of the torsion spring 53 is engaged with the body 13 for restricting the rotation of the latch 51 with a predetermined force and for biasing the latch 51 to return when the latch 51 is rotated. The latch 51 is maintained by the torsion spring 53 in order that an opening portion of an engaging groove 51*a* is approximately matched with an opening portion of an insert groove 15*a* provided at the base plate 15.

The pawl 52 is provided with the block-shaped main body 52*a* and the shaft portion 52*b* extending therefrom perpendicularly. The shaft portion 52*b* which extends completely through the body 13 and the sub base plate 14 terminates in an inner space of the second case portion 11*b* of the housing main body 11 and is rotatably supported by the sub base plate 14 and the base plate 15. The torsion spring 54 placed between the body 13 and the sub base plate 14 for biasing the pawl 52 is coaxially assembled around the shaft portion 52*b* of the pawl 52. A tip portion of the shaft portion 52*b* is fitted with the lift lever 42 (e.g., through a riveted fixation) so as to be rotated as one unit. One end of the torsion spring 54 is engaged with the pawl 52 and the other end of the torsion spring 54 is engaged with the sub base plate 14. The torsion spring 54 restricts the rotation of the pawl 52 with a predetermined force and biases the pawl 52 to return when the pawl 52 is rotated. The main body 52*a* of the pawl 52 is in contact with the outside periphery of the latch 51.

When a striker 56 provided at a vehicle-body side enters through the insert groove 15*a* of the base plate 15, the latch 51 receives the striker 56 and is rotated by the pushing operation of the striker 56 against the force of the torsion spring 53. Meanwhile, the pawl 52 is in sliding engagement with an outer surface of the latch 51 to be engaged with an engaging portion 51*b* as shown in FIG. 2. Thus, the latch 51 is held by the pawl 52 in a rotated state receiving the striker 56. The striker 56 is engaged with the latch 51 and the engaging state is maintained. Under this state, the door is in the closed state.

The latch 51 is biased to return by the torsion spring 53 in the engaging state. When the pawl 52 is rotated to be removed or separated from the engaging portion 51*b* of the latch 51 due to the rotation of the lift lever 42, the latch 51 is returned by the biasing force of the torsion spring 53. The opening portion of the engaging groove 51*a* is rotated to be matched with the opening portion of the insert groove 15*a* of the base plate 15. Under this state, the striker 56 is movable through the engaging groove 51*a* of the latch 51 and the insert groove 15*a* of the base plate 15. Accordingly, the door is ready to open in this state. The pawl 52 functions to selectively establish the engaging state and the disengaging state between the latch 51 and the striker 56. When the pawl 52 is rotated against the force of the torsion spring 54, the pawl 52 is disengaged from the engaging portion 51*b* of the latch 51, and then the engaging state between the latch 51 and the striker 56 is released.

With the door lock apparatus constructed as described above, the following operations can be obtained: an operation establishing a locked state under which the engagement between the latch 51 and the striker 56 cannot be released; an operation establishing an unlocked state under which the engagement between the latch 51 and the striker 56 can be released; an operation which is performed for opening and closing the door under the unlocked state; an operation which is performed for opening and closing the door under the locked state (i.e., one-motion operation); an operation establishing a double-locked state under which the locked state cannot be varied or moved to the unlocked state; and an operation releasing the double-locked state. A detailed explanation of the operations is not included here as they are known to those in the art.

According to the above embodiment of the present invention, components such as the latch 51, the torsion spring 53 for biasing the latch 51, the pawl 52, the torsion spring 54 for biasing the pawl 52, the support pin 55, the lift lever 42, and the three rubber cushions as shown in FIG. 4 are assembled to a first body S1 which is provided by the body 13, the sub base plate 14, and the base plate 15. All of the components are integrally formed in advance as shown in FIGS. 9–12.

Meanwhile, the other components (components of the first operation mechanism 20 and the second operation mechanism 30, the open lever 41 of the third operation mechanism 40, the resinous support pin 43*a*, the torsion spring 43*b*, and the third inside lever 61) excluding the above described components are assembled to a second body S2 which is provided by the housing main body 11 and the cover 12. All components are integrally formed in advance as shown in FIG. 9.

Figure 9:
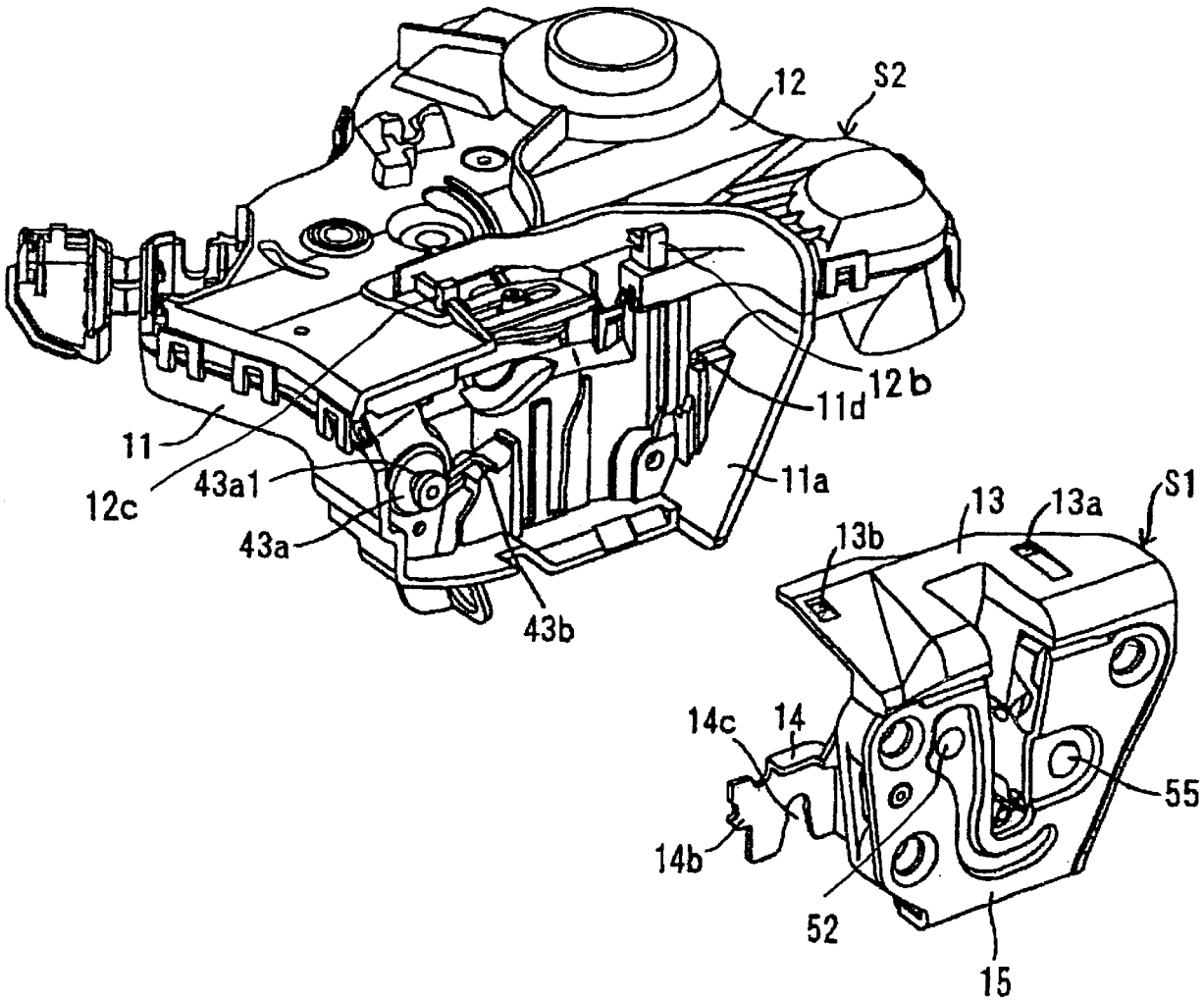
FIG. 9 is an exploded view of the door lock apparatus before a first body and a second body of the vehicle door lock apparatus are integrated.
Figure 10:
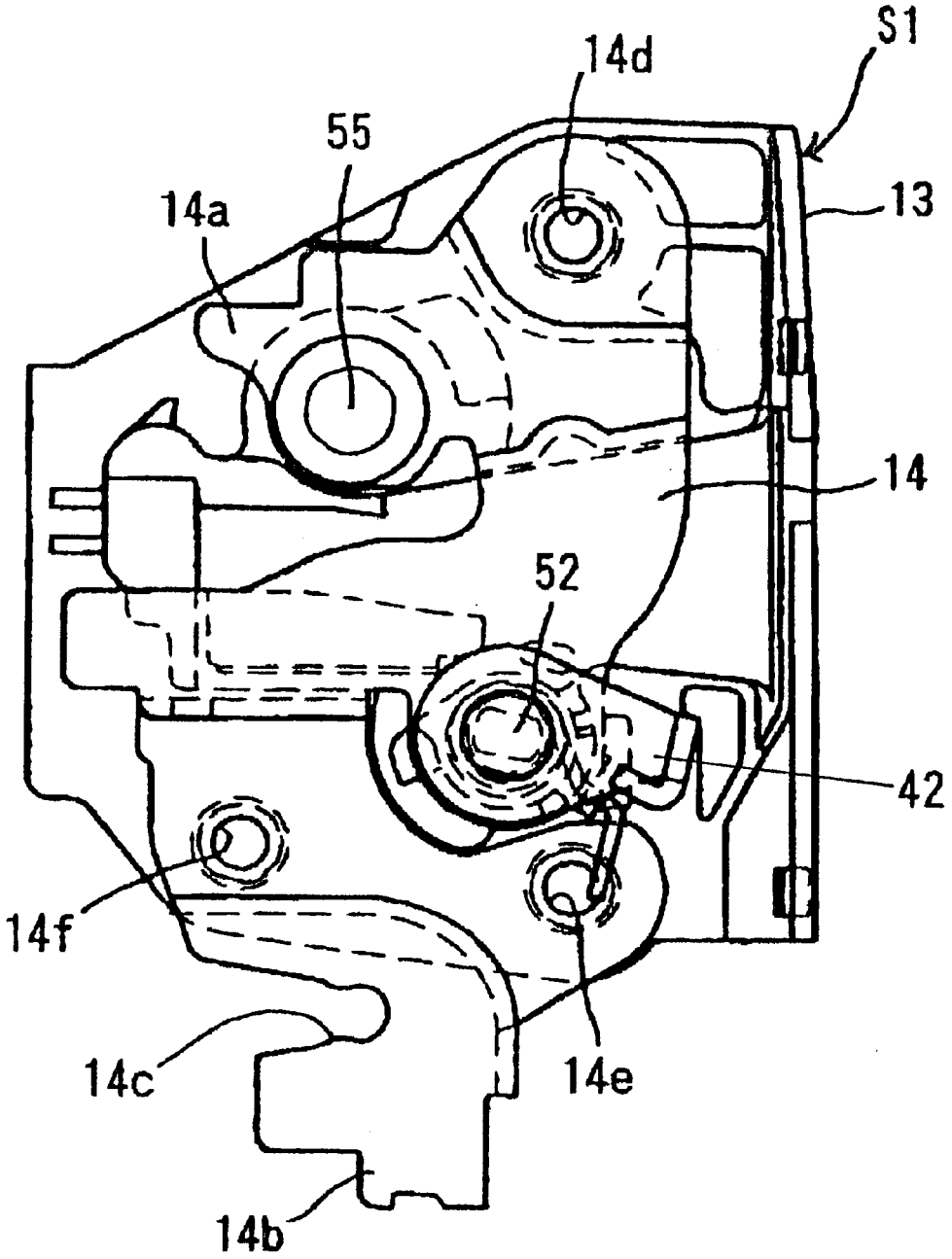
FIG. 10 is a front view of the first body shown in FIG. 9.
Figure 11:
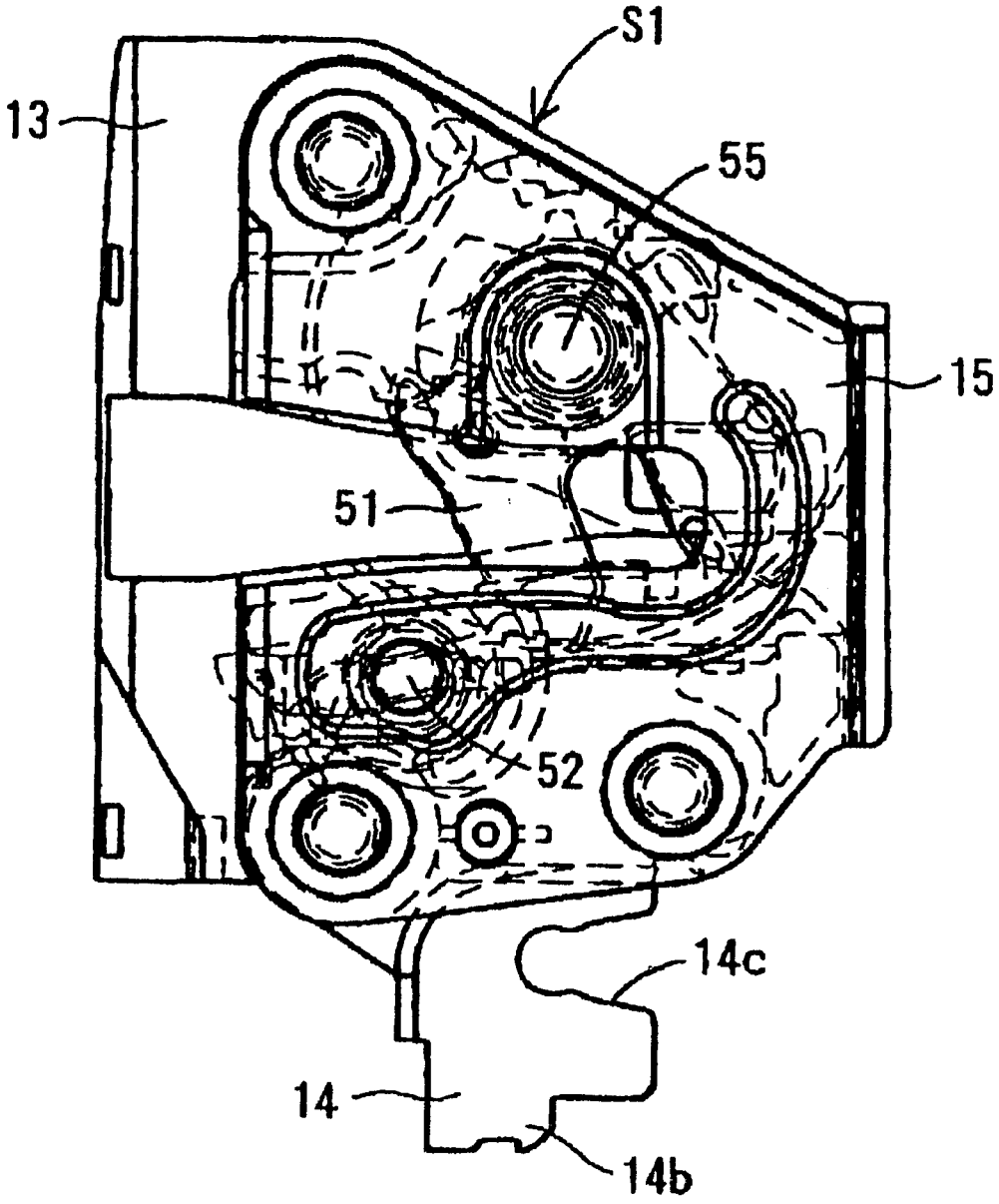
FIG. 11 is a rear view of the first body shown in FIG. 9.
Figure 12:
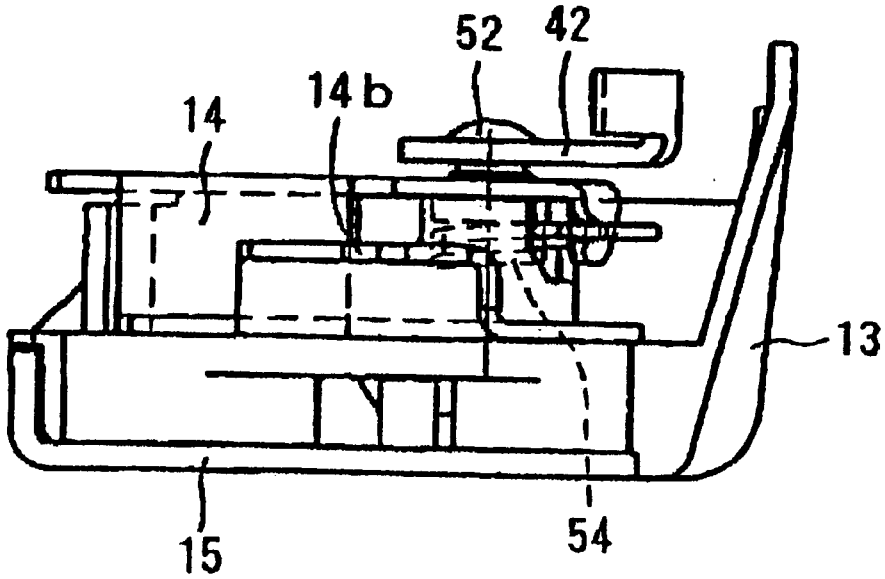
FIG. 12 is a bottom view of the first body shown in FIG. 9.
Figure 13:
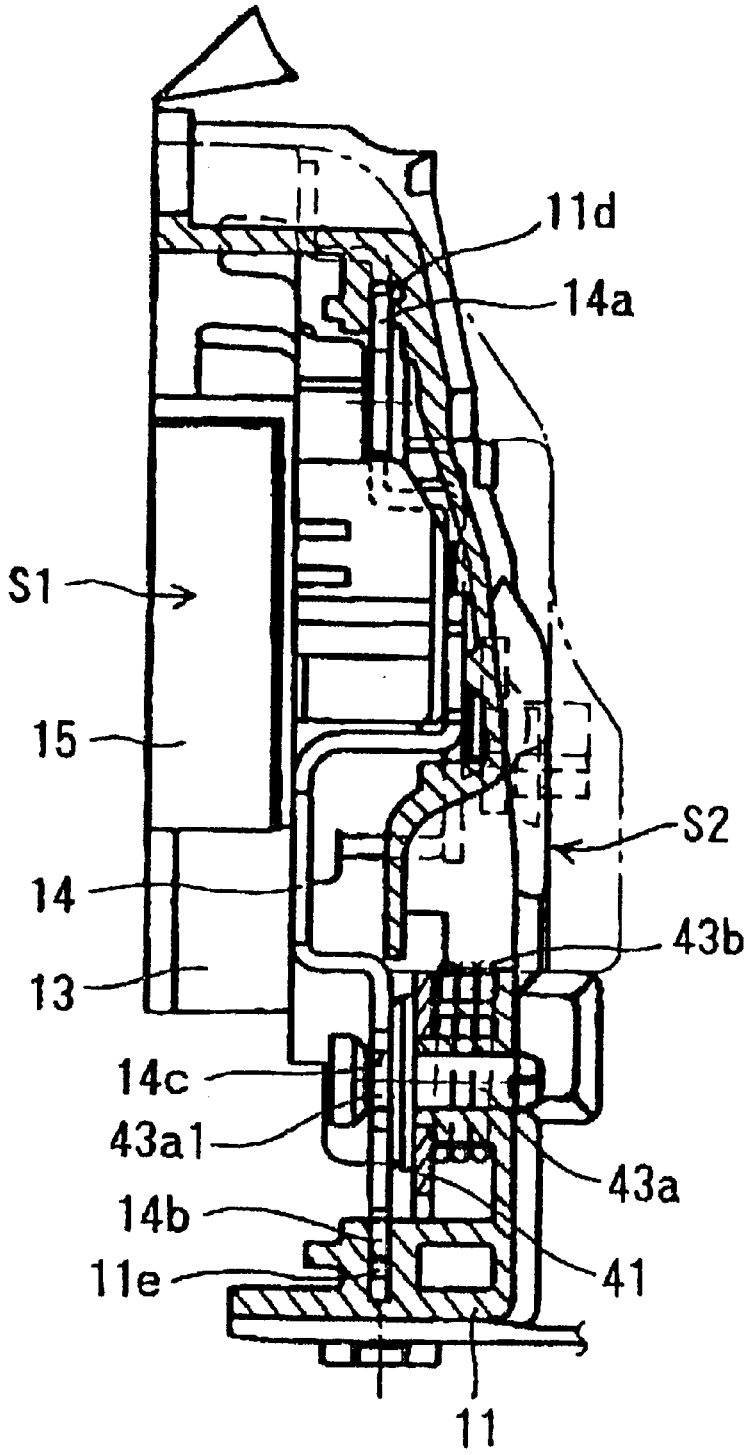
FIG. 13 is a vertical cross-sectional side view of the first body and the second body integrated with one another.

With the first body S1 and the second body S2 shown in FIG. 9 being integrally formed as shown in FIGS. 1–3 by assembling the first body S1 to the second body S2, the combination thereof is assembled to the door A with three installing bolts (not shown). In order to integrate the first body S1 and the second body S2, a pair of guide projections 14*a*, 14*b* are integrally formed at the sub base plate 14 which comprises the first body S1, and a pair of guide grooves 11*d*, 11*e* are integrally formed at the housing main body 11 which comprises the second body S2. The guide grooves 11*d*, 11*e* are slidably engaged with the guide projections 14*a*, 14*b* respectively. When the door lock apparatus of the present invention is assembled to the door A as shown in FIGS. 1–3 and the door A is closed, the guide grooves 11*d*, 11*e* and the guide projections 14*a*, 14*b* extend inward and outward of the vehicle. The number of guide projections 14*a*, 14*b* and guide grooves 11*d*, 11*e* can be appropriately adjusted.

The sub base plate 14 is integrally formed with an engaging groove 14*c* (having an engaging hole which can be engaged with an engaging shaft portion 43*a*1 at an end portion, and a throttle portion with slightly smaller width than the diameter of the engaging shaft portion 43*a*1) which can be engaged with the engaging shaft portion 43*a*1 formed at the resinous support pin 43*a* of the third operation mechanism 40. The engaging groove 14*c* functions together with the engaging shaft portion 43*a*1 as a stopper for preventing the separation of the integrated first and second bodies S1, S2. The engaging shaft portion 43*a*1 is enlarged relative to the engaging groove 14*c*. The cover 12 is integrally formed with a pair of projections 12*b*, 12*c* locating by being engaged with a pair of engaging square holes 13*a*, 13*b* provided at the body 13.

Accordingly, when the guide projections 14*a*, 14*b* are slidably engaged with the guide grooves 11*d*, 11*e* respectively, the projections 12*b*, 12*c* of the cover 12 are engaged with the engaging square holes 13*a*, 13*b* of the body 13 as shown in FIG. 1, while the engaging groove 14*c* of the sub base plate 14 is engaged with the engaging shaft portion 43*a*1 of the resinous support pin 43*a* to function as the stopper for preventing the separation of the integrated first and second bodies S1, S2. The number of stoppers can be appropriately adjusted.

In the embodiment of the present invention as described above, a pair of the guide projections 14*a*, 14*b* and the engaging groove 14*c* are integrally formed at the sub base plate 14. A pair of the guide grooves 11*d*, 11 *e* are integrally formed at the housing main body 11, and the engaging shaft portion 43*a*1 is integrally formed at the resinous support pin 43*a*. In addition, the integration of the first body S1 and the second body S2 can be effected or completed by both bodies S1, S2 being relatively moved and the stopper configured with the engaging groove 14*c* and the engaging shaft portion 43*a*1 prevents the separation of the integrated first body S1 and second body S2 achieved by the sliding engagement between the guide projections 14*a*, 14*b* and the guide grooves 11*d*, 11*e*. Accordingly, compared to a construction in which a connecting member is used for the integration of the first body S1 and the second body S2, the number of components can be reduced and the assembling work can be improved. Thus, the cost can be reduced.

In accordance with the present invention, with the door lock apparatus of the present invention being assembled to the door A and when the door A is closed, the guide grooves 11*d,* 11*e* are configured to be extended inward and outward of the vehicle. Thus when the vehicle is running, a load urging the engaging groove 14*c* and the engaging shaft portion 43*a*1 to be separated and affecting the engaging portion thereof is small. The engagement state of the engaging groove 14*c* and the engaging shaft portion 43*a*1 can thus be maintained for a long period.

In the above embodiment of the present invention, the guide projections 14*a,* 14*b* are provided at the first body S1, and the guide grooves 11*d,* 11*e* are provided at the second body S2. However, it is to be understood that the guide grooves can be provided at the first body and the guide projections provided at the second body. In addition, in the embodiment of the present invention, the stopper is configured with the engaging groove 14*c* formed at the sub base plate 14 comprising the first body S1 and the engaging shaft portion 43*a*1 formed at the resinous support pin 43*a* comprising the second body S2. However, other forms of the stopper can be appropriately configured and employed.

When the present invention is actually used in the door lock apparatus for an automobile with the first body S1 and the second body S2 being integrated, if at least one of the portions of the housing main body 11 corresponding to three tapped holes 14*d,* 14*e,* 14*f* (shown in FIG. 10) provided at the sub base plate 14 is formed with a concave portion (not shown), and the tip portion of an installing bolt (not shown) is configured to be engaged with the concave portion, the integrated state of the first body S1 and the second body S2 can be assured. In addition, the function of the stopper for preventing the separation of the second body S2 from the first body S1 can be reinforced.

In the embodiment of the present invention, the door lock apparatus includes the first operation mechanism 20, the second operation mechanism 30, and the third operation mechanism 40 provided at the housing 10. However, if the door lock apparatus is designed without the double-locked system, the second operation mechanism 30 might not be required. In this case, the receiving portion 24*b* provided at the lock operation lever 24 of the first operation mechanism 20 should possess an elongated shape where the third engaging pin 27*d* of the active lever 27 provided at the first operation mechanism 20 is inserted. Then the lock operation lever 24 and the active lever 27 are connected in such a manner that the engagement and the disengagement thereof are both impossible.

The principles, preferred embodiment and modes of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A vehicle door lock apparatus comprising:

a first body including a body part and a base plate;

a latch mechanism accommodated between the body part and the base plate, the latch mechanism including a latch adapted to engage a striker on the vehicle and a pawl for restricting rotation of the latch through engagement of the pawl with the latch;

a second body including a housing main body and a cover connected to the housing main body;

an operation mechanism accommodated between the housing main body and the cover to activate the pawl;

a guide projection provided at one of the first body and the second body;

a guide groove provided at the other one of the first body and the second body, the guide projection slidably engaging the guide groove so that the first and second bodies are integrated with one another;

at least one hole provided at one of the first body and the second body;

at least one projection provided at the other of the first body and the second body, the at least one projection projecting in a direction which causes the at least one projection to engage the at least one hole when the guide projection is slidably engaged with the guide groove; and a stopper provided between the first body and the second body for preventing separation of the first and the second bodies.

2. The vehicle door lock apparatus according to claim 1, wherein the stopper includes an engaging groove provided on the first body and an engaging shaft portion mounted on the housing main body.

3. The vehicle door lock apparatus according to claim 1, including a plurality of guide projections formed at one of the first body and the second body, and a plurality of guide grooves formed at the other one of the first body and the second body, each guide groove being engaged with one of the guide projections.

4. The vehicle door lock apparatus according to claim 1, wherein the first body also includes a sub base plate that is separate from the body part and the base plate, the base plate being positioned on one side of the body part and the sub base plate being positioned on an opposite side of the body part.

5. The vehicle door lock apparatus according to claim 4, wherein the guide projection is provided on the sub base plate.

6. The vehicle door lock apparatus according to claim 4, wherein the guide groove is provided on the housing main body.

7. The vehicle door lock apparatus according to claim 4, wherein the stopper includes an engaging groove formed on the sub base plate and a pin provided on the housing main body and engaged by the engaging groove.

8. The vehicle door lock apparatus according to claim 1, wherein the cover is provided with the at least one projection that engages the at least one hole which is provided in the body part of the first body.

9. A vehicle door lock apparatus comprising:

a first body accommodating a latch mechanism which includes a latch for effecting opening and closing of a vehicle door through engagement with a striker provided at a vehicle-body side and a pawl for restricting rotation of the latch through engagement of the pawl with the latch;

a second body accommodating an operation mechanism which activates the pawl;

the first body being integrated with the second body for being integrally assembled to the vehicle door;

a guide projection formed at one of the first body and the second body, and a guide groove formed at the other one of the first body and the second body, the guide groove being engaged with the guide projection; and a stopper provided between the first body and the second body for preventing separation of the integrated first and the second bodies by the engagement between the guide projection and the guide groove;

wherein the first body includes a body part, a base plate and a sub base plate, and the second body includes a housing main body and a cover connected to the housing main body, the cover being provided with at least one projection that engages a hole provided in the body part.

10. The vehicle door lock apparatus according to claim 9, wherein the stopper is comprised of an engaging groove provided at the first body and an engaging shaft portion provided at the second body.

11. The vehicle door lock apparatus according to claim 9, including a plurality of guide projections formed at one of the first body and the second body, and a plurality of guide grooves formed at the other one of the first body and the second body, each guide groove being engaged with one of the guide projections.

12. The vehicle door lock apparatus according to claim 9, wherein the first body includes a body part, a base plate and a sub base plate, the latch mechanism being accommodated between the body part and the base plate.

13. The vehicle door lock apparatus according to claim 12, wherein the guide projection is formed on the sub base plate.

14. The vehicle door lock apparatus according to claim 12, wherein the base plate is positioned on one side of the body part and the sub base plate is positioned on an opposite side of the body part.

15. The vehicle door lock apparatus according to claim 9, wherein the second body includes a housing main body and a cover connected to the housing main body.

16. The vehicle door lock apparatus according to claim 15, wherein the guide groove is formed on the housing main body.

17. The vehicle door lock apparatus according to claim 9, wherein the base plate is positioned on one side of the body part and the sub base plate is positioned on an opposite side of the body part.

18. A vehicle door lock apparatus comprising:

a first body including a body part and a base plate;

a latch mechanism accommodated between the body part and the base plate, the latch mechanism including a latch adapted to engage a striker on the vehicle and a pawl for restricting rotation of the latch through engagement of the pawl with the latch;

a second body including a housing main body and a cover connected to the housing main body;

an operation mechanism accommodated between the housing main body and the cover to activate the pawl;

a guide projection provided at one of the first body and the second body;

a guide groove provided at the other one of the first body and the second body, the guide projection engaging the guide groove so that the first and second bodies are integrated with one another in a manner preventing relative pivoting movement of the first and second bodies;

at least one hole provided at one of the first body and the second body;

at least one projection provided at the other of the first body and the second body, the at least one projection engaging the at least one hole; and said first body being provided with an engaging portion and said second body being provided with an engaging portion, the engaging portion of the first body being engaged with the engaging portion of the second body to prevent separation of the first and second bodies.

19. The vehicle door lock apparatus according to claim 18, wherein the engaging portion of the second body is a shaft portion provided with an enlargement and the engaging portion of the first body is a groove provided at the first body that is engaged by the shaft portion.

* * * * *